US006471060B1

(12) United States Patent
Leyshon

(10) Patent No.: US 6,471,060 B1
(45) Date of Patent: Oct. 29, 2002

(54) DOLL CASE

(75) Inventor: Frank A. Leyshon, Cambridge, OH (US)

(73) Assignee: Leyshon Miller Industries, Inc., Cambridge, OH (US)

( * ) Notice: Subject to any disclaimer, the term of this patent is extended or adjusted under 35 U.S.C. 154(b) by 0 days.

(21) Appl. No.: 09/759,696

(22) Filed: Jan. 12, 2001

Related U.S. Application Data

(60) Provisional application No. 60/175,814, filed on Jan. 12, 2000.

(51) Int. Cl.[7] ..... B65D 21/02

(52) U.S. Cl. ..... 206/473; 206/472; 206/560; 206/747; 220/528; 446/73

(58) Field of Search ..... D3/295; 206/472, 206/508, 747–750, 757, 762, 1.5, 279, 285, 473, 560, 771, 776, 526; 220/831, 832, 520, 522, 523, 526–528, 535, 538–540; 446/73–75, 80, 296; 211/7; 312/216

(56) References Cited

U.S. PATENT DOCUMENTS 2,278,124 A * 3/1942 Kowinski ..... 446/73
2,544,975 A * 3/1951 Berger ..... 220/831
2,748,928 A * 6/1956 Stavis et al. ..... 206/762
4,030,235 A * 6/1977 Terzian et al. ..... 446/296
4,165,579 A * 8/1979 Chase ..... 446/73
5,013,278 A * 5/1991 Dixon ..... 446/73
5,152,710 A * 10/1992 Montgomery ..... 446/75
5,738,241 A * 4/1998 McEntee ..... 206/508
5,799,791 A * 9/1998 Harley ..... 206/757
6,022,259 A * 2/2000 Rudawsky et al. ..... 446/80
6,176,680 B1 * 1/2001 Horn ..... 220/520
D444,300 S * 7/2001 Leyshon ..... D3/295
6,319,087 B1 * 11/2001 Ferrigno ..... 446/73

* cited by examiner

*Primary Examiner*—Jim Foster
(74) *Attorney, Agent, or Firm*—Robert R. Lech; Calfee, Halter & Griswold LLP

(57) ABSTRACT

A doll case arrangement for storing, transporting and displaying at least one doll is disclosed. The doll case arrangement includes an outer shell and at least one removable display housing. The display housing is intended to house a doll or a set of doll accessories. The outer shell is adapted to receive the at least one removable display housing. Preferably, the outer shell comprises a spine connected to two molded halves. Each molded half forms at least one interior storage cavity adapted to receive a removable display housing. Further, the connection between each molded half and the spine forms a hinge enabling the molded halves to open and close with respect to each other.

10 Claims, 11 Drawing Sheets

DOLL CASE

CROSS-REFERENCE TO RELATED APPLICATIONS

This Application claims the benefit of U.S. Provisional Patent Application Serial No. 60/175,814, filed Jan. 12, 2000, which is hereby incorporated by reference.

STATEMENT AS TO RIGHTS TO INVENTIONS MADE UNDER FEDERALLY SPONSORED RESEARCH AND DEVELOPMENT

This patent is not based upon any federally sponsored research and development.

BACKGROUND OF THE INVENTION

1. Field of the Invention

The present invention relates generally to cases for storing, protecting, transporting and displaying dolls and other collectibles. Specifically, the present invention relates to a protective case containing at least one transparent, removable modular insert for protecting and displaying a doll or doll-related accessories.

2. Description of the Related Art

Cases for toys, and particularly for dolls and doll accessories are well known. Such cases are generally intended to provide a convenient way to organize, store, transport, protect and/or display such dolls and doll accessories. While some doll cases are merely intended to provide protection during transportation or storage, other cases have been designed to function as a display for dolls when the case is placed in an open configuration.

Exemplary patents disclosing prior art doll cases include: U.S. Pat. Nos. 4,054,191, 4,165,579, Des. 268,040 and Des. 316,735. U.S. Pat. No. 4,054,191 discloses a case fabricated of sheet material for carrying toys and/or dolls. The carrying case of the '191 patent is intended not only to provide a means for carrying and storing dolls, but also to provide a certain atmosphere related to the toys stored therewith when the case is in an open position.

U.S. Pat. No. 4,165,579 discloses a toy fashion display mechanism contained within a two-compartment carrying case. The invention of the '579 patent enables a doll to be stored and transported in the disclosed carrying case. When opened, the carrying case of the '579 patent may be used to display a doll in an upright position using the disclosed toy doll display mechanism, including a rotatable turntable.

U.S. Design Patents 268,040 and 316,735 disclose a toy vanity case and a combined doll and pillow carrying case, respectively. The toy vanity case of the '040 patent appears to provide storage and transportation of vanity supplies, and a display for such supplies when the case is disposed in an open position. The carrying case of the '735 patent appears to be designed for transporting a doll and pillow, and possibly for displaying the doll.

These and other prior art doll cases have several shortcomings which are solved by the present invention. A first shortcoming is that prior art doll cases are typically made of vinyl or cardboard and fail to provide adequate protection for collectible dolls. A second shortcoming is that prior art doll cases fail to protect stored dolls when disposed to display the stored dolls. Another shortcoming is that prior art doll cases fail to individually protect each stored doll separately from any other stored dolls. A further shortcoming of the prior art doll cases is that they do not allow a complete inspection of a doll without requiring the doll to be removed or otherwise handled. The present invention addresses these and other shortcomings of the prior art.

SUMMARY OF THE INVENTION

OBJECTS OF THE INVENTION

It is an object of the present invention to provide a doll case that separately and individually protects at least one doll or set of doll accessories stored therein.

It is another object of the present invention to provide a doll case that enables transportation of at least one separately and individually protected doll or set of doll accessories contained therein.

It is a further object of the present invention to provide a doll case that enables all of the separately and individually protected dolls and sets of doll accessories contained therein to be displayed.

It is yet a further object of the present invention to provide a doll case that enables a doll or set of doll accessories to be separately and individually protected even when removed from the doll case.

In carrying out the above objects and other objects of the present invention, a doll case is provided for protecting dolls against handling and damage during storage and transportation. The doll case of the present invention includes a protective outer shell and at least one removable doll housing. The outer shell is preferably constructed of injection-molded plastic, and may include a handle to facilitate carrying the doll case. The outer shell preferably constructed of two hinged halves which, when closed, form the exterior portion of the doll case and completely enclose any dolls to be protected, stored or transported.

Each removable modular doll housing is designed to house an individual doll or set of doll accessories. Preferably, a portion of the removable modular doll housing is transparent to allow inspection of a doll stored within the housing. Each removable modular doll housing is designed to fit into a cavity formed by the interior surface of the outer shell of the doll case.

It is an advantage of the present invention to provide greater protection for dolls and doll accessories during storage, transportation and display. This advantage is possible because the removable doll housing isolates each doll or set of doll accessories, thereby reducing any wear and tear caused by transportation or storage. Further, the transparent portion of the removable doll housing enables display and inspection of a doll or set of doll accessories without requiring direct contact or handling, thereby protecting and preserving the enclosed doll or set of doll accessories.

The objects, features and advantages of the present invention are readily apparent from the following description of the preferred embodiments when taken in connection with the accompanying drawings.

BRIEF DESCRIPTION OF THE DRAWINGS

Comprehension of the invention is facilitated by reading the following detailed description, in conjunction with the associated drawings, in which.

DRAWING REFERENCE NUMERALS

Figure 1:
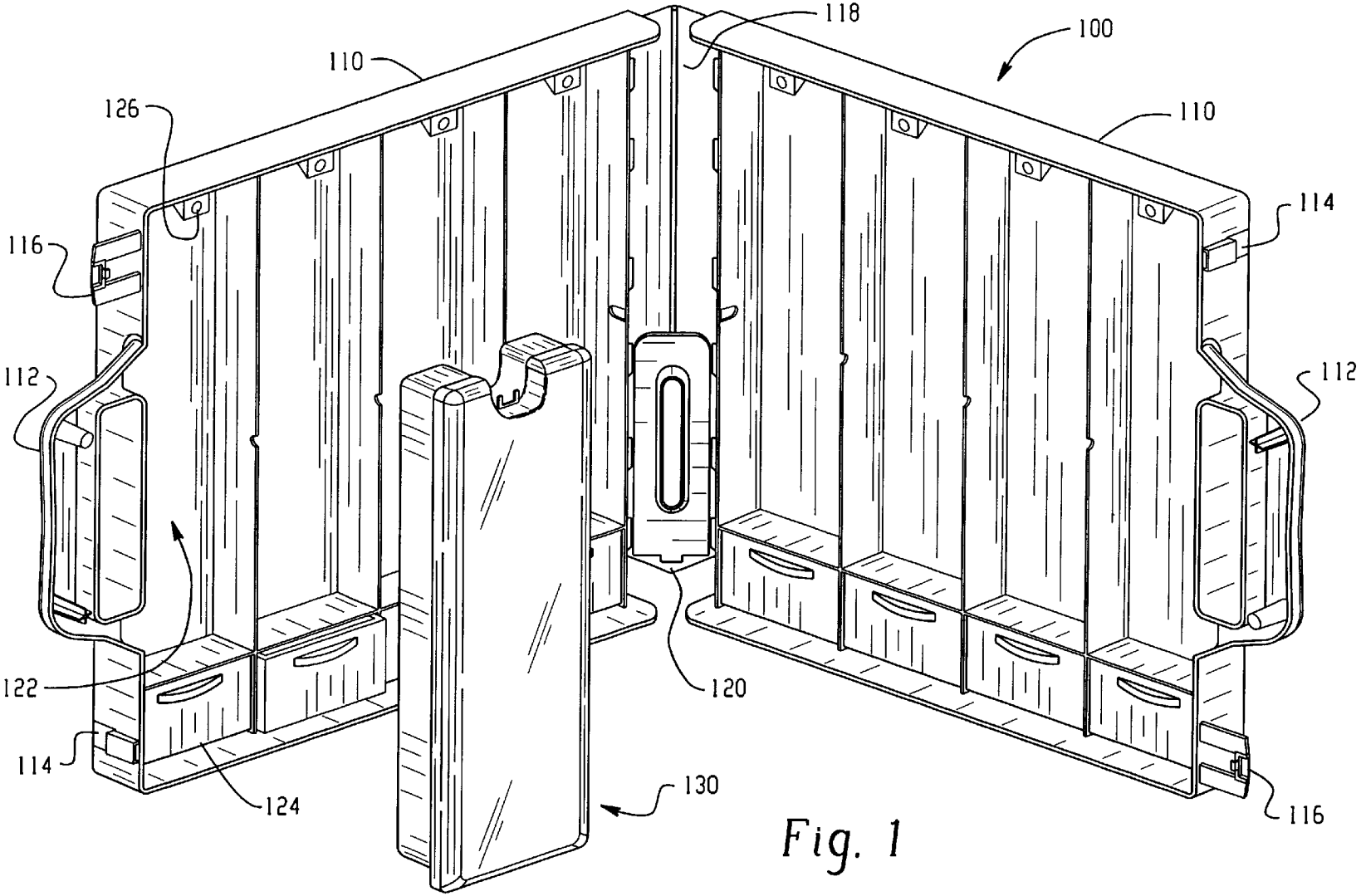
FIG. 1 is a perspective view of a doll case according to the present invention with a modular doll housing removed from the outer shell of the doll case.

The following reference characters identify the associated elements depicted in the drawings describing the present invention:

TABLE A

| Element Descriptions and Associated Reference Numerals | |
|---|---|
| 100 | Doll Case |
| 110 | Molded Half |
| 112 | Handle Portion |
| 114 | Retaining Latch |
| 116 | Latch Clip |
| 118 | Spine |
| 120 | Integral Foot |
| 122 | Storage Cavity |
| 124 | Drawer |
| 126 | Post |
| 130 | Modular Doll Housing |
| 410 | Doll |
| 412 | Hanger |
| 510 | Container Portion |
| 512 | Lid Portion |
| 710 | Handle |
| 810 | Molded Foot |
| 812 | Integral Foot Attachment Mechanism |
| 910 | Retaining Bar |

DETAILED DESCRIPTION OF THE DRAWINGS

Referring now to the drawing figures, there is illustrated in FIG. 1, a doll case 100 embodying the present invention. Doll case 100 includes an outer shell formed of two molded halves 110. Each molded half includes a handle portion 112, a retaining latch 114 and a latch clip 116. The outer shell of doll case 100 further includes a spine 118 to which molded halves 100 are attached. The attachment of each molded half 110 to spine 118 forms a hinge which enables doll case to open and close. Molded halves 110 are shown in FIG. 1 in an open position, thereby displaying the contents of doll case 100. When molded halves 110 are in a sufficiently open position, a user may access integral foot 120 which is attached to spine 118 by a hinge perpendicular to the hinges attaching the molded halves 110. Although integral foot 120 is shown in a retracted position in FIG. 1, it may be extended by rotating the non-hinged end of integral foot 120 away from spine 118, thereby providing support for doll case 100, as shown more particularly with reference to FIG. 2.

As further illustrated in FIG. 1, the interior surface of each molded half 110 forms four storage cavities, generally referred to by reference numeral 122. Each storage cavity 122 may be used to store a doll or set of doll accessories. A doll may be stored in storage cavity 122 simply by placing the doll within the cavity, but the preferred means for storing a doll within storage cavity 122 is by utilizing modular doll housing 130, as described in more detail below and with reference to FIGS. 3, 5 and 6.

Modular doll housing 130 is a protective shell designed to contain a single doll or a set of doll accessories. Preferably, housing 130 includes two portions, a container portion 510 and a lid portion 512, shown in more detail with reference to FIG. 5. Utilizing modular doll housing 130, a doll may be inserted and removed from storage cavity 122 without requiring the doll to be directly handled. This is an advantage because it protects a doll from oils and dirt which may be on a person's hand, and acts to preserve the condition of the doll. Constructing modular doll housing 130 of transparent molded plastic (e.g., acrylic, polycarbonate, crystal styrene) provides a further advantage enabling a doll to be examined without direct contact. Of course, much of the utility of the present invention can still be achieved by making only select portions of housing 130 transparent, such as lid portion 512.

Figure 4:
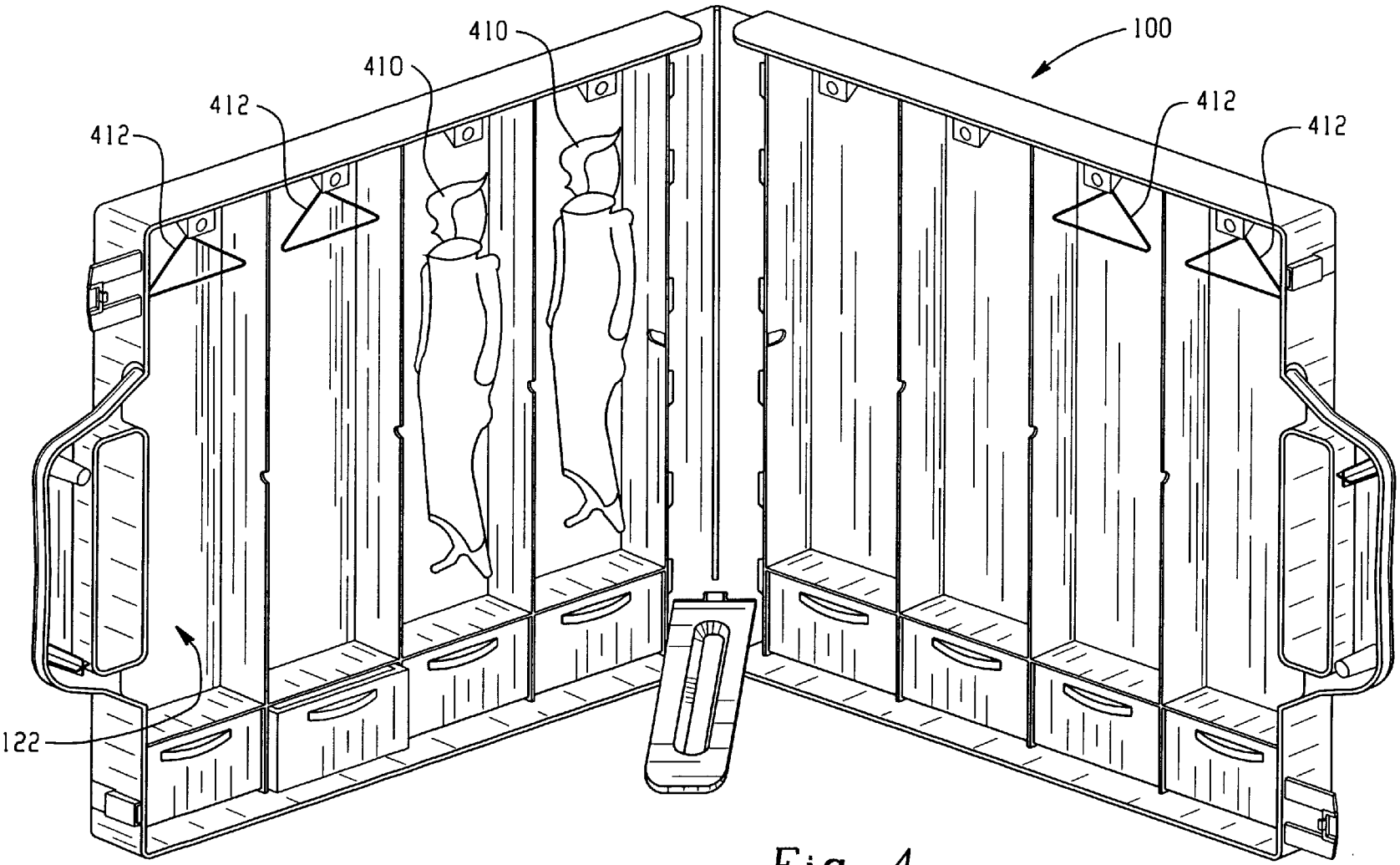
FIG. 4 is a perspective view of the outer shell of the doll case of FIG. 1.
Figure 11:
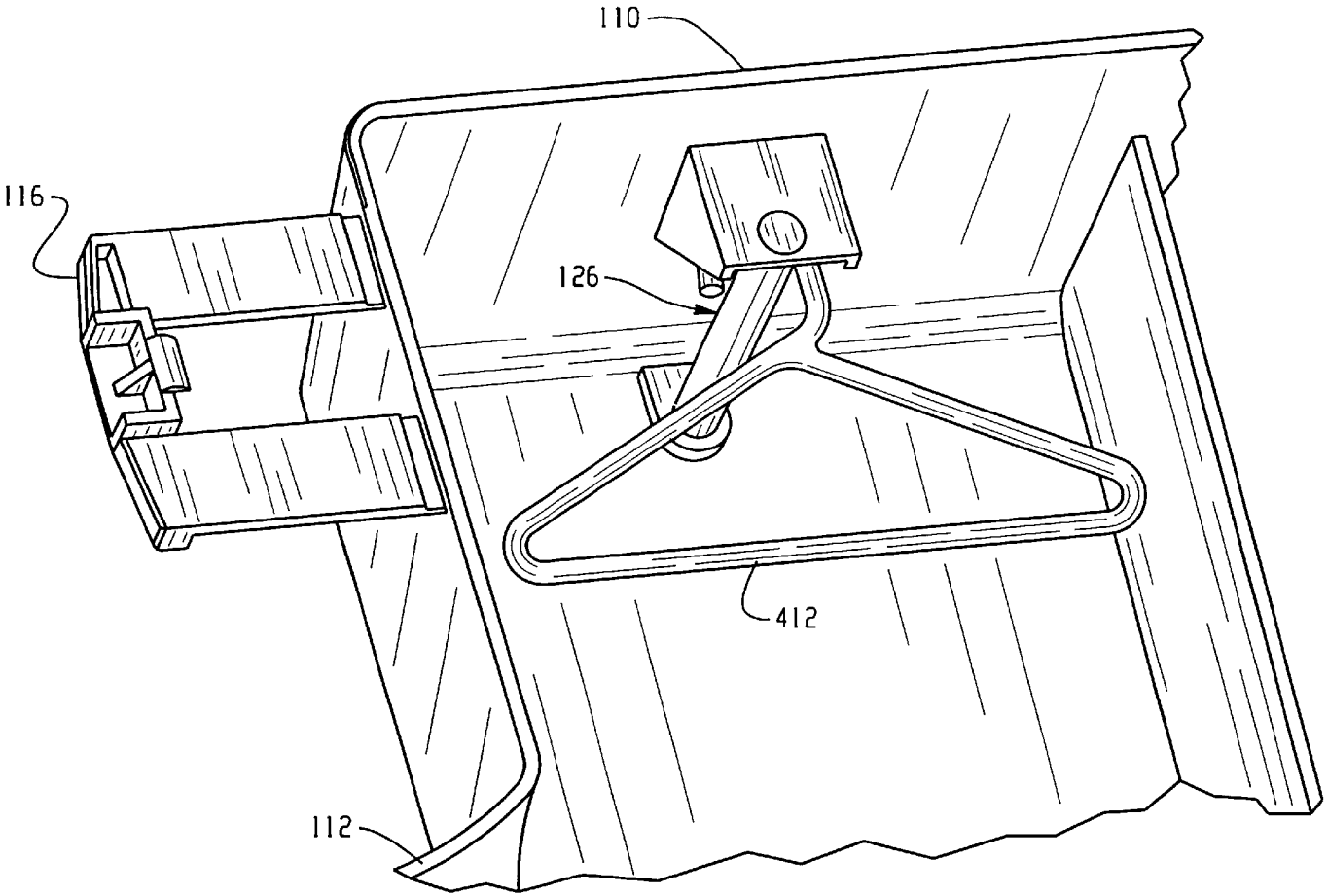
FIG. 11 is a magnified perspective view of a corner portion of the outer shell of the doll case of FIG. 1.

A set of doll accessories may be stored within cavity 122 by enclosing the doll accessories within modular doll housing 130, or by securing the doll accessories to post 126 using a hanger 412, as shown in more detail with respect to FIGS. 4 and 11. Although either means of storing doll accessories within cavity 122 is acceptable, storing them using modular doll housing 130 has the advantage of protecting the accessories from damage caused by handling and other environmental factors. Of course, in addition to storing doll accessories within storage cavity 122, doll accessories may be further stored in drawer 124.

Figure 2:
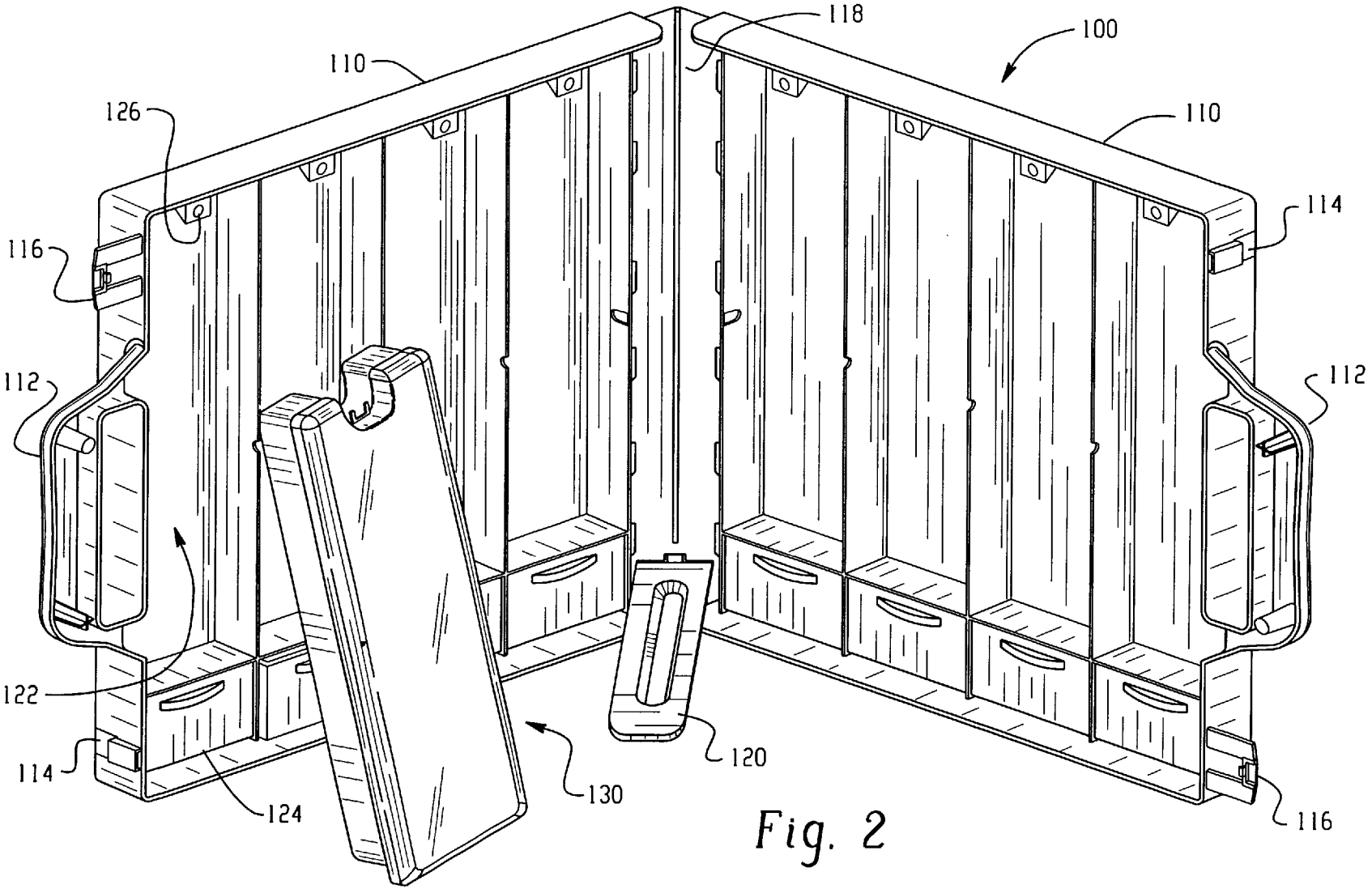
FIG. 2 is a perspective view of the doll case of FIG. 1 with the modular doll housing positioned to be received by the outer shell of the doll case.

Referring now to FIG. 2, doll case 100 is illustrated in an open position, with modular doll housing 130 positioned to be inserted into cavity 122. As contrasted with FIG. 1, integral foot 120 is shown to have been rotated about its hinge and is disposed in an extended position supporting doll case 100. Preferably, integral foot 120 includes a mechanism which allows it to be temporarily fixed in the extended position until it is no longer necessary to support doll case 100.

Figure 3:
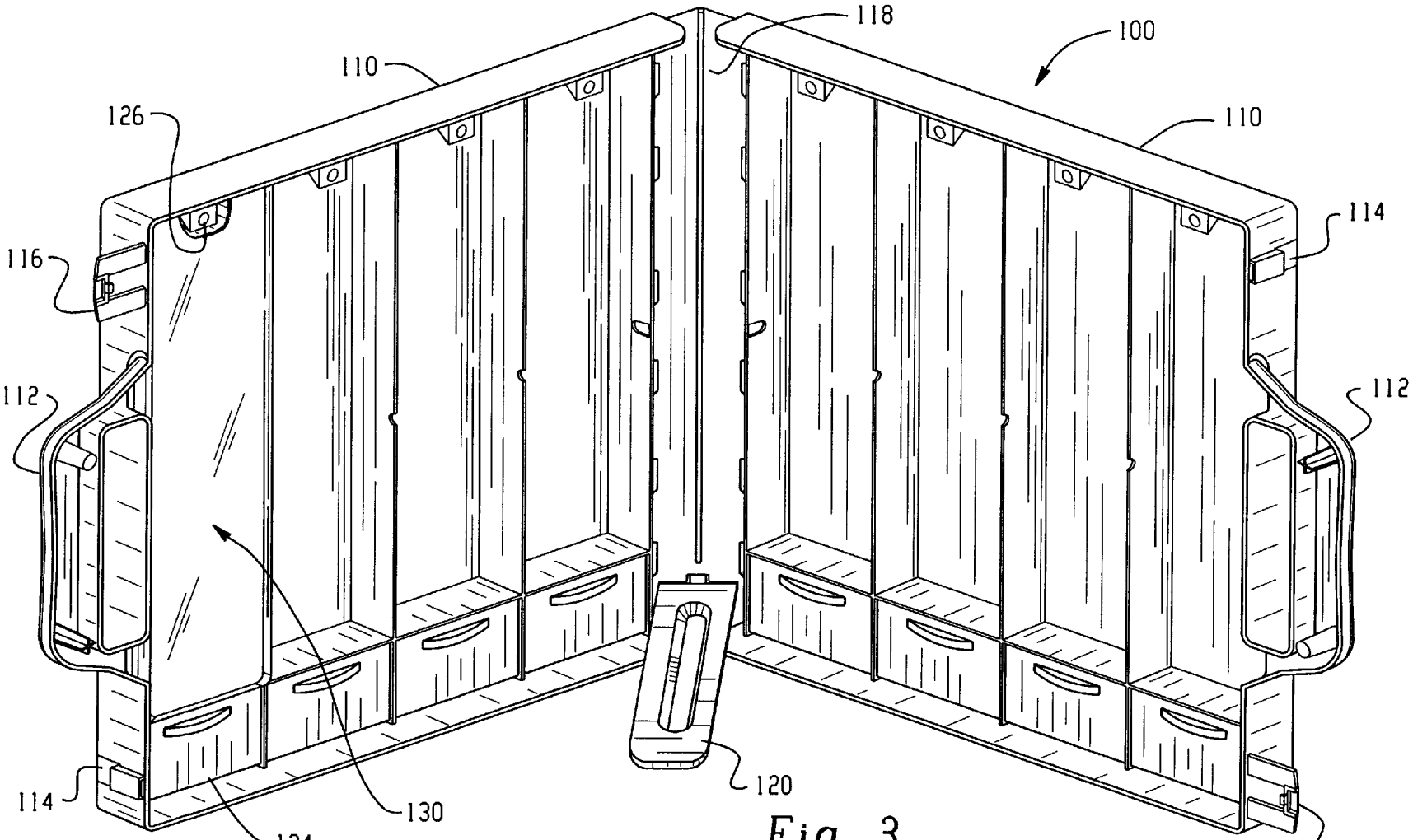
FIG. 3 is a perspective view of the doll case of FIG. 1 with the modular doll housing inserted into the outer shell.

Referring now to FIG. 3, doll case 100 is illustrated in an open position, with modular doll housing 130 disposed within storage cavity 122. Modular doll housing 130 is preferably retained within cavity 122 by post 126.

Referring now to FIG. 4, doll case 100 is illustrated in an open position illustrating that doll case 100 may be used without employing modular doll housing 130. As shown, doll case 100 contains two dolls 410 and four hangers 412 in six respective storage cavities 122.

Figure 5:
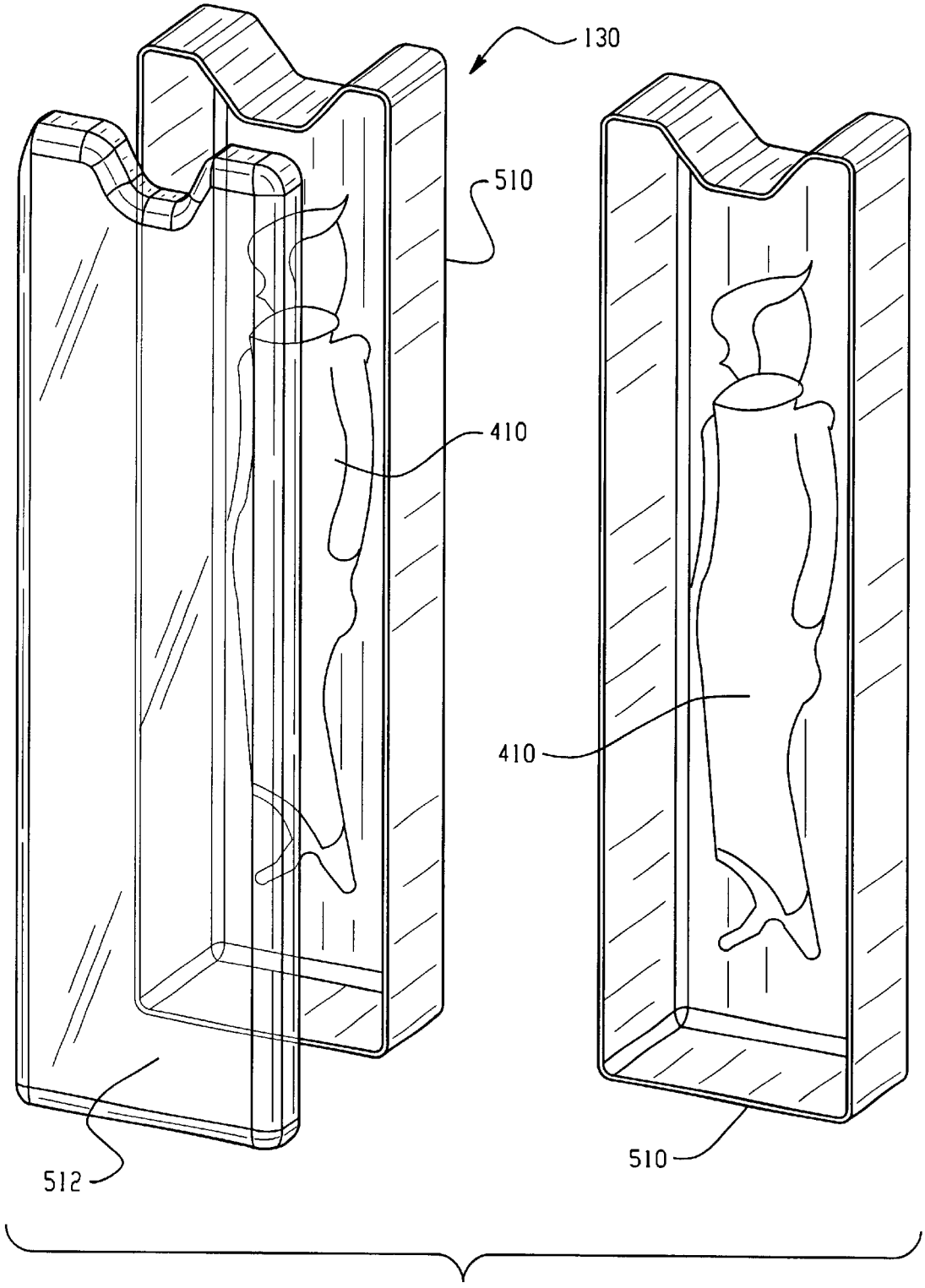
FIG. 5 is a perspective view of a modular doll housing according to the present invention.

Referring now to FIG. 5, modular doll housing 130 is illustrated in more detail. Modular doll housing 130 comprises two portions: a container portion 510 and a lid portion 512. Preferably, the container portion 510 and lid portion 512 are constructed to snap or otherwise fasten together, thereby providing a secure and convenient means for handling and storing an enclosed doll 410.

As shown, modular doll housing 130 is designed to receive and contain doll 410. Of course, doll housing 130 may also receive and store other items such as doll accessories. To enclose a doll 410 within modular doll housing 130, doll 410 may be placed in container portion 510, and lid portion 512 is mated with and fastened to container portion 510. Once doll 410 is enclosed in modular doll housing 130, the assembly may be inserted into a storage cavity 122 within doll case 100, as shown in FIGS. 3 and 6.

Figure 6:
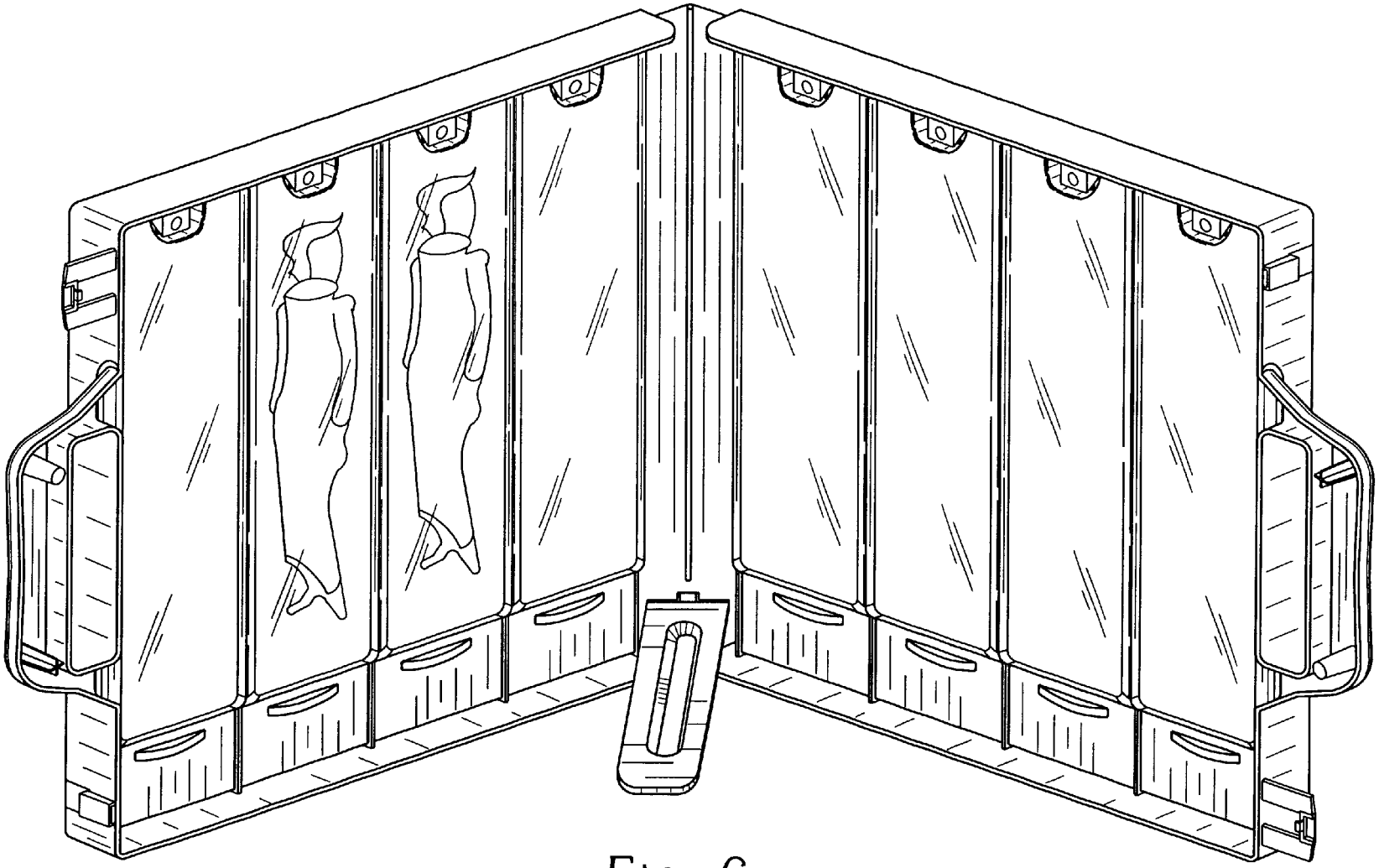
FIG. 6 is a perspective view of the doll case of FIG. 1, wherein the outer shell is fully populated with modular doll housings.

FIG. 6 illustrates doll case 100 in an open position and fully populated with eight modular doll housings 130. As shown, two of the modular doll housings contain dolls 410, and six of the housings 130 are empty.

Figure 7:
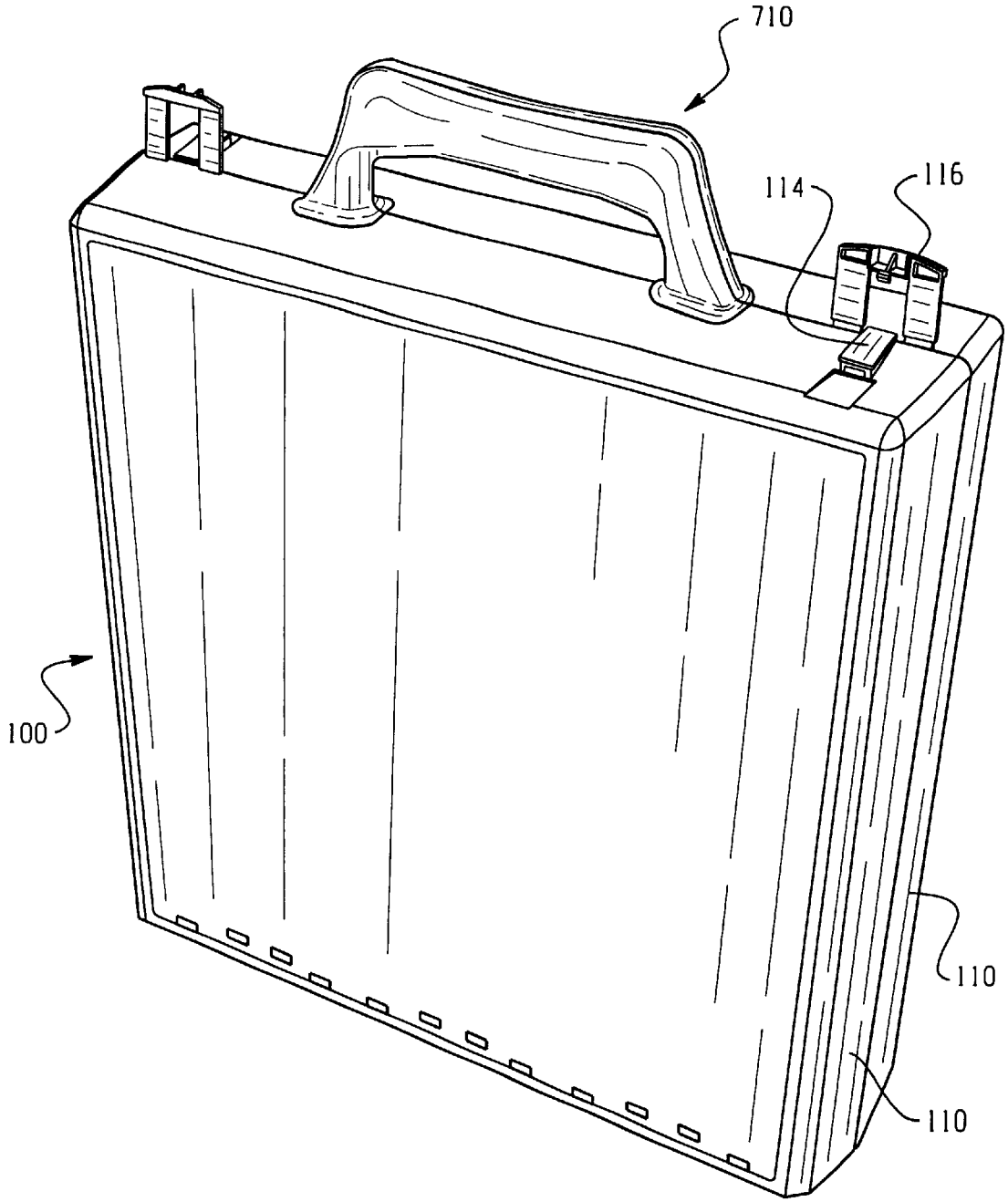
FIG. 7 is a perspective view of the doll case of FIG. 1 in a closed configuration.

Referring now to FIG. 7, there is illustrated doll case 100 in a closed, unlatched position. When both molded halves 110 are disposed in a closed position, handle portions 112 mate to form a handle 710. Further, retaining latches 114 align with latch clips 116, when molded halves 110 are disposed in a closed position, enabling latch clips 116 to be fastened to retaining latches 114, thereby fastening molded halves 110 to one another. In this way, doll case 100 may be securely closed to enable transportation of doll case 100 and any enclosed dolls 410 or doll accessories.

Although doll case 100 is illustrated without any decoration, doll case 100 may be decorated in a number of ways. Preferably, doll case 100 is constructed of molded plastic having a color that is suitable for the intended users. For example, pink might be a suitable color to use for a doll case 100 that is intended to contain female dolls, and blue might be a suitable color to use for a doll case 100 that is intended to contain male dolls. Army green or camouflage might be used for a doll case 100 intended to contain military dolls. Further, the face of doll case 100 may be used to display photographs, pictures, text or other indicia indicating the intended use of the doll case 100.

Figure 8:
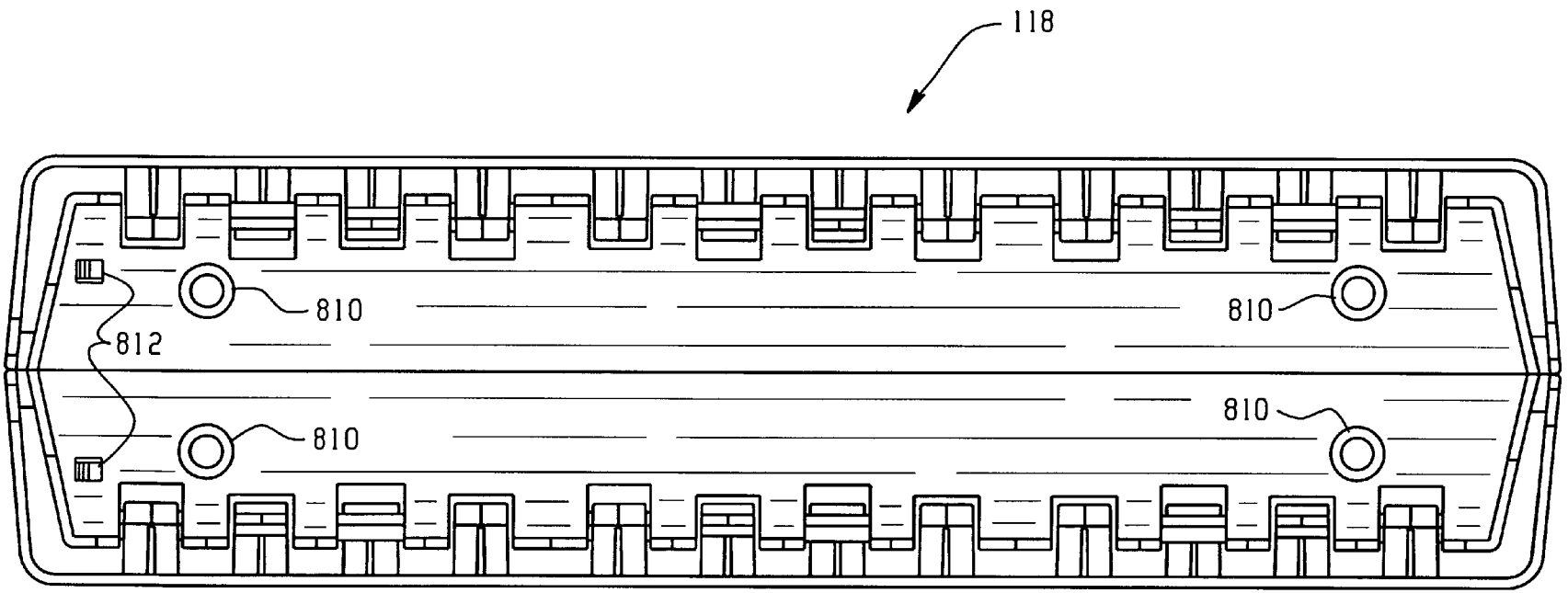
FIG. 8 is an plan view of a hinge for connecting the two halves of the doll case of FIG. 1.

Referring now to FIG. 8, there is illustrated spine 118. As shown, spine 118 preferably includes four molded feet for supporting doll case 100 in a closed portion. Further, spine 118 preferably includes an attachment and hinge mechanism 812 for integral foot 120.

Figure 9:
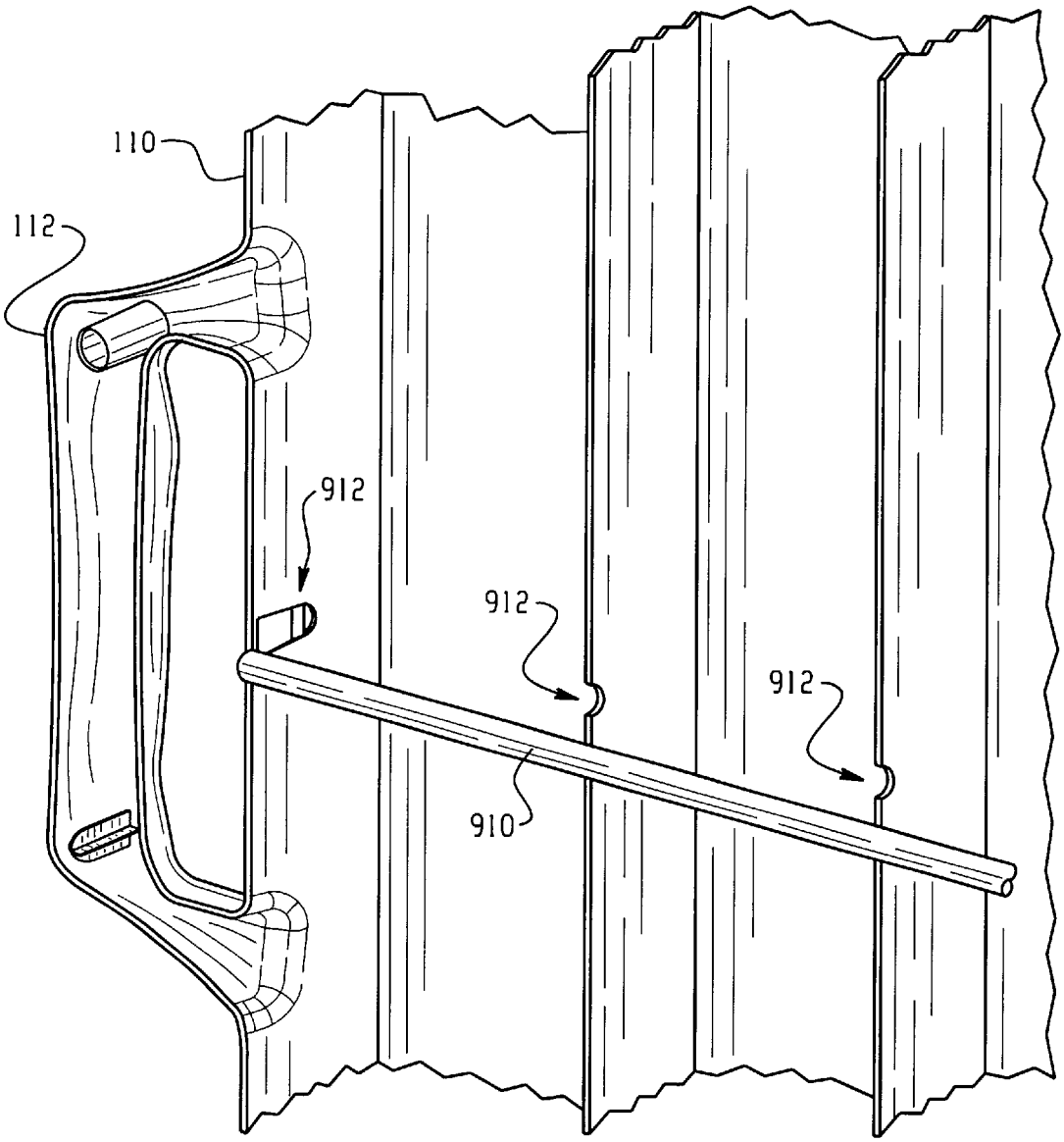
FIG. 9 is a first magnified view of a portion of the outer shell of the doll case of FIG. 1 and a retaining bar.

Referring now to FIG. 9, there is presented a magnified perspective view of molded half 110. As shown, the portions of the inner surface of molded half 110 which form walls defining cavities 122 further define notches 912. Notches 912 are aligned generally perpendicular to handle portion 112 to enable a user to insert retaining bar 910 into the series of notches, thereby providing a means for retaining any dolls which are stored in any cavity 122 of molded half 110. Tension clips 914 on opposing sides of molded half 110 provide a means for removably fastening retaining bar 910 to molded half 110.

Figure 10:
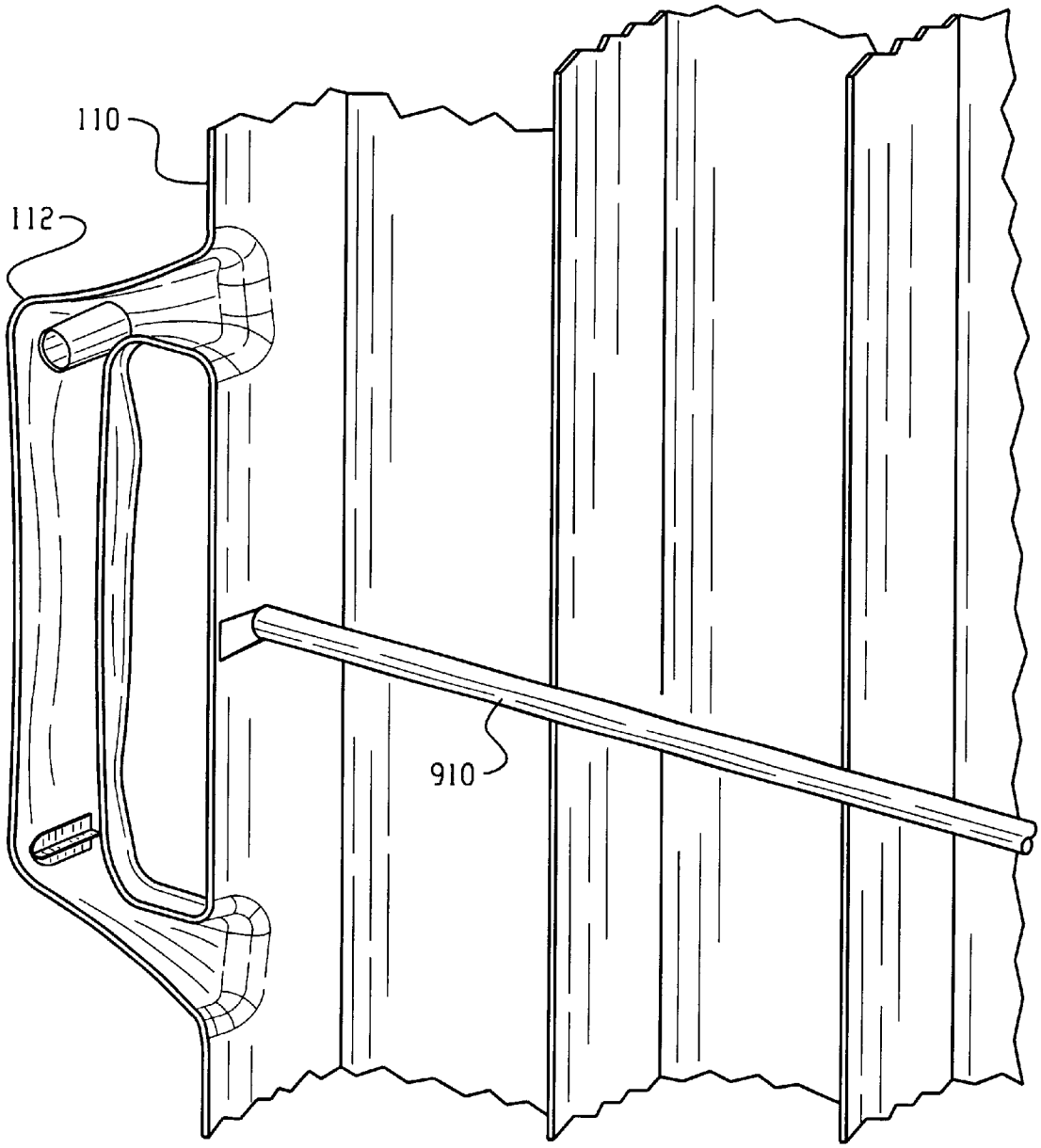
FIG. 10 is a second magnified view of a portion of the outer shell of the doll case of FIG. 1 and a retaining bar.

Referring now to FIG. 10, molded half 110 is illustrated with retaining bar 910 fastened in a retaining position. As illustrated, retaining bar 910 can be fastened to molded half 110 only if no modular doll housings 130 have been inserted into molded half 110. Of course, specialized modular doll housings could be designed to include slots which correspond with the position of retaining bar 910, thereby enabling stored dolls to be both retained and protected.

Referring now to FIG. 11, a magnified perspective view of molded half 110 is presented which more clearly illustrates the configuration and utility of post 126.

OPERATIONAL DESCRIPTION OF THE PRESENT INVENTION

As the attached drawings readily illustrate, doll case 100 may be used by a doll owner to protect, store transport and display dolls. By placing a doll 410 in a modular doll housing 130 and storing both the doll 410 and the modular doll housing 130 in doll case 100, the doll 410 is suitably protected from damage. By first placing doll 410 in modular doll housing 130, the doll is not only protected during storage and transportation, but also during display and handling. Doll case 100 of the present invention may also include other elements such as hangers for storing doll clothes and drawers for storing doll clothes and accessories.

Although the invention has been described in terms of specific embodiments and applications, persons skilled in the art can, in light of this teaching, generate additional embodiments without exceeding the scope or departing from the spirit of the claimed invention. Accordingly, it is to be understood that the drawing and description in this disclosure are proffered to facilitate comprehension of the invention, and should not be construed to limit the scope thereof.

What is claimed is:

1. A doll case arrangement, the arrangement comprising:

an outer shell comprising a frame and a plurality of partitions defining a plurality of interior storage cavities, the outer shell further comprising a plurality of posts, each post respectively disposed within a corresponding interior storage cavity; and a removable doll housing adapted to fully enclose a doll, the removable doll housing configured to fit within one of the interior storage cavities of the outer shell, the removable doll housing including a contoured portion to mate with one of the posts of the outer shell when the removable doll housing is disposed within the interior storage cavity of the outer shell.

2. The arrangement of claim 1, wherein each of the posts of the outer shell is configured to retain the removable doll housing when it is disposed within a corresponding interior storage cavity.

3. The arrangement of claim 1, wherein at least a portion of the removable doll housing is transparent.

4. The arrangement of claim 1, wherein the outer shell further comprises a plurality of drawers, each drawer adjacent to one of the plurality of interior storage cavities.

5. The arrangement of claim 1, wherein the outer shell further comprises an integral foot, the foot being attached to the spine by a hinge, the foot rotatable between a first position in which the foot is disposed substantially parallel with the axis of the spine and a second position in which the foot angles outward from the spine.

6. A doll case arrangement, the arrangement comprising:

an outer shell comprising:

a frame defining the sides of the outer shell, the frame including at least one retention clip; and a plurality of partitions disposed within the frame, the partitions and frame defining a plurality of interior storage cavities, each partition forming a notch aligned with the retention clip of the frame; and a retaining bar disposed within the notches of the partitions, the retaining bar cooperating with the retention clip to secure the retaining bar relative to the frame and the partitions.

7. The arrangement of claim 6, further comprising a doll disposed within one of the interior storage cavities, the doll secured within the interior storage cavity by the retaining bar.

8. The arrangement of claim 6, wherein the frame includes a plurality of retention clips and the retaining bar cooperates with more than one retention clip.

9. The arrangement of claim 8 wherein the frame defines a notch adjacent to each retention clip, and the retaining bar is further configured to fit within the notch defined by the frame.

10. The arrangement of claim 6, further comprising at least one removable doll housing adapted to fully enclose a doll, the removable doll housing configured to fit within one of the interior storage cavities of the outer shell, the removable doll housing further configured to fit below the retaining bar when the removable doll housing is disposed within the interior storage cavity of the outer shell and the retaining bar is disposed within the notches of the partitions.

* * * * *